United States Patent [19]

Tada et al.

[11] Patent Number: 4,491,476

[45] Date of Patent: Jan. 1, 1985

[54] BORON-CONTAINING STEEL AND A PROCESS FOR PRODUCING THE SAME

[75] Inventors: Hideaki Tada; Yoshiaki Aoki, both of Hyogo, Japan

[73] Assignee: Sumitomo Electric Industries, Ltd., Osaka, Japan

[21] Appl. No.: 482,087

[22] Filed: Apr. 4, 1983

[30] Foreign Application Priority Data

Apr. 3, 1982 [JP] Japan ..... 57-55924

[51] Int. Cl.[3] ..... C22C 38/14

[52] U.S. Cl. ..... 75/124; 75/126 D; 75/126 P; 148/36; 148/2; 148/12 F; 164/459

[58] Field of Search ..... 75/124 B, 126 D, 126 P, 75/123 B; 148/12 B, 12 R, 12 F, 2, 36; 164/477, 473, 459, 485

[56] References Cited

U.S. PATENT DOCUMENTS 3,717,508 2/1973 Melloy et al. ..... 148/2

FOREIGN PATENT DOCUMENTS 52-41114 3/1977 Japan ..... 148/36

55-91935 7/1980 Japan ..... 148/36

*Primary Examiner*—M. J. Andrews

*Assistant Examiner*—Debbie Yee

*Attorney, Agent, or Firm*—Sughrue, Mion, Zinn, Macpeak, and Seas

[57] ABSTRACT

A boron-treated steel comprises a carbon steel, or a low alloy steel containing 0.15 to 0.85% C, 0.15 to 2.0% Si, 0.3 to 1.5% Mn, not more than 1.0% Cr, not more than 0.020% of P and S each, and unavoidable quantities of Al and Ti not exceeding 0.008% and 0.010%, respectively, and further contains 6 to 30 ppm of acid-soluble boron. The steel produced is less likely to develop cracks and can be produced at substantially reduced costs.

3 Claims, 3 Drawing Figures

BORON-CONTAINING STEEL AND A PROCESS FOR PRODUCING THE SAME

FIELD OF THE INVENTION

This invention relates to steel containing boron and a process for producing the same.

BACKGROUND OF THE INVENTION

Steel which contains boron is usually used for producing high tensile strength steel at a low cost. Its hardenability is a factor which has an important bearing on the strength and toughness of a product obtained by quenching and tempering.

Boron is added to steel for the sole purpose of improving its hardenability. Large quantities of aluminum and titanium are always added, too, in order to eliminate undesirable effects of nitrogen on boron so that the boron may be fully effective. The addition of aluminum and titanium also has a grain-refining effect. It is usually necessary and sufficient to add boron in such a quantity that steel may contain 5 to 20 ppm of acid-soluble boron.

The production and use of boron steel, however, involve the following disadvantages:

(1) In the event a steel wire having a tensile strength of 150 kg/mm$^2$ is produced by oil tempering, the ductility of the product is not very high immediately after heat treatment, but is recovered to a prescribed level with the lapse of time. If the product is meanwhile under stress, "delayed fracture" is likely to occur.

(2) When a continuously cast billet is hot rolled, it is likely to crack along an oscillation mark. This is particularly likely when a hot continuously cast billet is reheated and rolled.

(3) Boron steel is difficult to be cast continuously, since aluminum, which is essential for boron steel, is likely to close a tundish nozzle. Titanium has a similar action, but if its quantity is small, heavy corrosion of nozzle refractories takes place, and renders continuous-continuous casting difficult.

SUMMARY OF THE INVENTION

In the production and use of boron steel, it is an object of this invention to prevent the formation of any surface cracks during hot rolling, particularly continuous casting-hot charge rolling, improve the delayed-fracture resistance of a quenched and tempered steel product of high tensile strength, and facilitate a long period of continuous casting.

In an attempt to eliminate the drawbacks of the prior art as hereinabove pointed out, the inventors of this invention have carefully studied the effects which trace elements, such as B, Al, Ti, N and O, may have on the properties of steel. As a result, the present inventors have found that it is necessary to reduce the quantities of aluminum and titanium as much as possible, since they have an adverse effect on the ductility of the product during the period of several to several tens of hours after quenching and tempering. It has also been found important to keep the quantity of aluminum at or below a certain level and eliminate titanium completely in order to prevent the cracking of steel during the hot charge rolling of a continuously cast billet, and particularly when a continuously cast billet is directly hot rolled. These measures greatly facilitate the continuous casting of boron steel, but the shortage of aluminum and titanium presents a problem in the fixing of nitrogen. If nitrogen is appropriately fixed, boron is not fully utilized to ensure the hardenability of steel. According to this invention, therefore, a large quantity of boron is added to steel so that boron may fix the nitrogen which has hitherto been fixed by aluminum and titanium, while the quantity of acid-soluble boron, which has a bearing on the hardenability of steel, is maintained at a certain level.

This invention, thus, provides boron-treated steel consisting essentially of 0.15 to 0.85% C, 0.15 to 2.0% Si, 0.3 to 1.5% Mn, not more than 1.0% Cr, not more than 0.020% of P and S each, 6 to 30 ppm of acid-soluble boron, not more than 0.008% Al and not more than 0.010% Ti.

The steel of this invention has a total boron content of at least 40 ppm, as opposed to conventional boron steel in which the acid-soluble boron content and the total boron content are substantially equal and in the range of 4 to 20 ppm, and which contains 0.015 to 0.050% Al and 0.020 to 0.060% Ti.

DETAILED DESCRIPTION ON THE INVENTION

Figure 1:
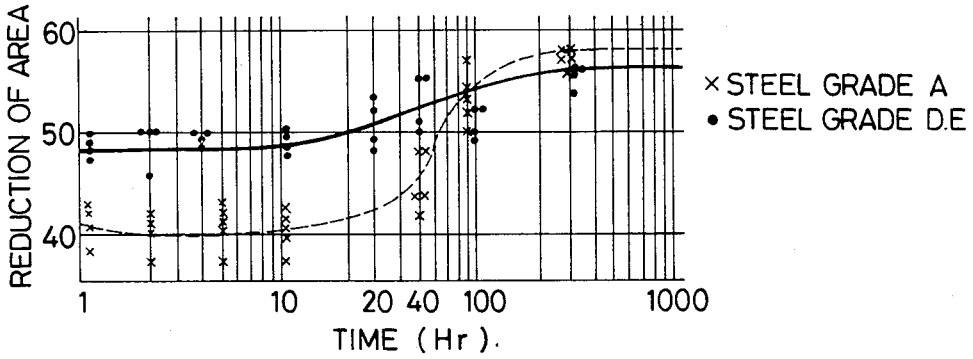
FIG. 1 is a graph showing changes with the lapse of time in the reduction of area of high tensile strength steel wire obtained by quenching and tempering.

When the content of carbon is below 0.15% by weight the steel does not have a sufficient strength, while if it is above 0.85% by weight the effect of boron is not obtained and the resulting steel becomes brittle.

Silicon when contained in an amount of below 0.15% by weight leads to improper deoxidation, and therefore sound steel cannot be obtained. Steel containing above 2.0% by weight of silicon is brittle.

Steel whose manganese content is below 0.3% by weight becomes brittle upon hot rolling. The content of manganese of above 1.5% by weight brings about no additional effect but renders the steel rather brittle.

Chromium gives an adverse influence on weldability of the steel when it is contained in an amount of above 1.0% by weight.

Phosphorus and sulfur each gives an adverse effect on delayed fracture when they are contained in the steel in an amount of above 0.020% by weight.

No sufficient hardenability is obtained when the acid soluble boron is contained is an amount of below 6 ppm. On the other hand, when it is contained in an amount of above 30 ppm the steel becomes brittle during hot rolling.

Aluminum is contained in an amount of above 0.008% by weight tends to give rise to surface defect during hot rolling when in coexistence with boron.

Also, titanium if contained in an amount of above 0.010% by weight tends to cause surface defect during hot rolling when in coexistence with boron.

Preferred boron treated steel consists essentially of 0.20–0.35% C, 0.18–0.30% Si, 0.60–0.90% Mn, 0.01–0.50% Cr, not more than 0.015% of P and S each, 6–25 ppm of acid-soluble boron, not more than 0.008% Al, and not more than 0.10% Ti.

Particularly preferred boron steel consists essentially of 0.25–0.35% C, 1.3–1.7% Si, 0.6–0.9% Mn, 0.05–0.30% Cr, not more than 0.010% of P and S each, and 10 to 20 ppm of acid soluble boron.

TABLE 1

| Steel | C | Si | Mn | P | S | Al | Ti | Total Boron | Acid-Soluble Boron (%) |
|---|---|---|---|---|---|---|---|---|---|
| A | 0.30 | 0.23 | 0.81 | 0.016 | 0.015 | 0.038 | 0.06 | 0.0018 | 0.0017 |
| B | 0.31 | 0.28 | 0.82 | 0.012 | 0.008 | 0.025 | 0.02 | 0.0019 | 0.0015 |
| C | 0.30 | 0.25 | 0.77 | 0.013 | 0.012 | 0.017 | 0.00 | 0.0040 | 0.0018 |
| D | 0.31 | 0.26 | 0.79 | 0.009 | 0.008 | 0.004 | 0.02 | 0.0057 | 0.0013 |
| E | 0.31 | 0.25 | 0.77 | 0.011 | 0.007 | 0.003 | 0.00 | 0.0062 | 0.0010 |

Tensile tests were conducted at certain intervals of time, beginning immediately after tempering, to clarify the possibility of aging in the mechanical properties of the steel wire. The tests indicated a substantial constancy in tensile strength, but revealed an aging phenomenon in the reduction of area, which is a measure of ductility, as shown in FIG. 1. As is obvious from FIG. 1, all of the steel grades tested showed a relatively low degree of reduction of area immediately after heat treatment, but an improved and constant reduction of area after several days, while the initial ductility of steel A was extremely low as compared with that of the other grades.

It is known that the aging phenomenon as hereinabove described is due to the behavior of diffusible hydrogen in steel. If the product is used or placed under a high stress during the initial period when its ductility is still low, a delayed fracture is very likely to start at a stress concentration point such as a surface defect. Steels D and E, which contain only very small quantities of aluminum and titanium if any, have a considerably high initial ductility as shown in FIG. 1, and therefore, a high degree of delayed-fracture resistance. This is probably due to the fact that titanium inhibits the diffusion of hydrogen atoms.

The hot workability of continuously cast billets was tested. As regards steel A, a billet was formed from an ingot and hot rolled into a rod, and its surface was examined for cracking during the hot rolling operation. As regards the other grades of steel, a hot bloom obtained by continuous casting was (a) directly charged into a heating furnace at a temperature of at least 900° C., (b) was directly charged into a heating furnace at a temperature of about 800° C., or (c) cooled to ordinary room temperature, and then those blooms were heated to 1,200° C., and hot rolled into a billet, and its surface was examined for cracking during the hot rolling operation. After each billet had been conditioned for the removal of its surface defects, it was reheated to 1,200° C. and rolled into a rod, and its surface was examined for cracking during the hot rolling operation.

Table 2 compares the five grades of steel in hot workability, continuous casting suitability and the hardenability and delayed-fracture resistance of the steel product.

TABLE 2

| | Continuous Casting | | | Surface cracking in hot charge rolling at various charge-temperatures | | | | Steel Product | |
|---|---|---|---|---|---|---|---|---|---|
| Grade | Nozzle closing | Nozzle corrosion | Time (H) | 900° C. | 800° C. | 30° C. | 30° C. re-hot rolling | Hardenability | Delayed fracture |
| A | — | — | — | — | — | — | | ≧5 mm (good) | frequency ≧0.01 1/ton of steel (bad) |
| B | 0.2 mm/min | — | — | X | XX | Δ | | ≧5 mm | ≧0.01 |
| C | 0.05 mm/min | 0 | 2 | X | X | Δ | | ≧5 mm | ≦1 1/$10^3$ tons of steel (good) |
| D | 0 | 0.02 mm/min | 3 | X | XX | Δ | | ≧5 mm | ≦1 |
| E | 0 | 0 | 8 | | | | | ≧5 mm | ≦1 |

No. of cracks ≦0.4 1/m
ΔNo. of cracks 0.4~8 1/m
X No. of cracks 8~40 1/m
XX No. of cracks 40≦1/m Table 2 teaches the following:

(1) No crack appears in a hot rolled billet when it is hot rolled again. This is probably due to the fact that the grain boundary of initial crystals in the surface layer, which is brittle as a result of rolling, is destroyed, resulting in the disappearance of notches and the dispersion of a boron compound precipitated in the grain boundary.

(2) Boron steel, except steel E of this invention, is very likely to crack in the surface during the hot charge rolling of a continuously cast billet, i.e., when a continuously cast billet is directly charged into a heating furnace, heated and rolled. This tendency is much greater when the billet is charged into the heating furnace at 800° C. than when it is charged at 900° C. The poor hot workability of boron steel is due to the grain boundary of initial crystals embrittled by the precipitation of a boron compound, as is well known.

There are known a number of methods for preventing the cracking of a steel surface during hot charge rolling. Examples of such methods include:

(1) Keeping the quantity of boron in steel at a minimum level which is necessary, as is precisely controlling the work-heat hysteresis so that all of the boron in the steel may be utilized effectively for improving its hardenability; and (2) Removing a surface layer from a billet by hot scarfing or grinding to eliminate any and all points where cracks are likely to start.

The former method, however, has the disadvantage of requiring a high level of control technique, and the latter has the disadvantages of a lower yield and a higher production cost.

According to this invention, boron is added in a quantity several times greater than in ordinary boron steel, while no aluminum or titanium is added. Therefore, simple BN is the only boron compound formed in the boron steel of this invention, and moreover, it is precipitated not only in the grain boundary, but also in other sites. Therefore, the problem of hot brittleness is solved, and the hardenability of steel is guaranteed in accordance with this invention.

When a cold billet is hot rolled, it is considerably less likely to crack than a hot billet, since it undergoes pearlitic and austenitic transformation during the cooling and reheating processes, resulting probably in the recrystallization of its structure and the rearrangement of a boron compound.

Figure 2:
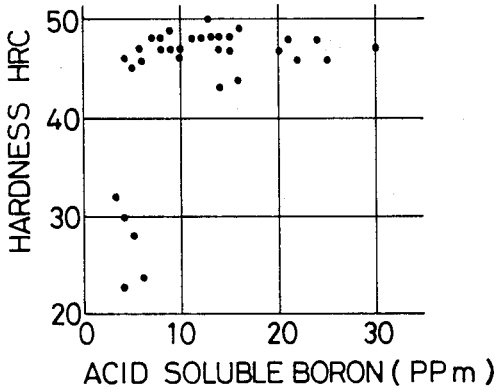
FIG. 2 is a graph showing the relation between the quantity of acid-soluble boron in steel and the hardness of steel at a distance of 5 mm from its end quenched for a Jominy test.

The hardenability of steel was examined. A Jominy test specimen was taken from a crop end during rod rolling, and its hardness was examined at a distance of 5 mm from the end quenched for a Jominy test. FIG. 2 shows the relation between the quantity of acid-soluble boron in each of steels C, D and E and its hardness at a distance of 5 mm from the quenched end. As is obvious from FIG. 2, the acid-soluble boron in the quantity of about 6 ppm or more ensures a satisfactory level of hardenability.

Figure 3:
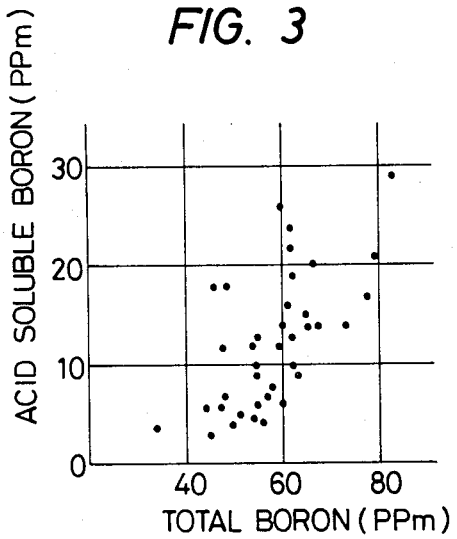
FIG. 3 is a graph showing by way of example the relation between the total boron content of steel and its acid-soluble boron content.

FIG. 3 shows the relation between the total boron contents of steels C, D and E and their acid-soluble boron contents. Most of the boron in steel combines with nitrogen, and most of the remaining boron is acid-soluble boron. FIG. 3 teaches that steel contains about 6 ppm or more of acid-soluble boron if it has a total boron content of about 50 ppm or more, though their relationship may naturally depend on the conditions of melting, refining and hot rolling.

Table 2 also compares the various grades of steel with respect to their suitability for continuous casting. Steel A is very likely to close a tundish nozzle. It is well known that steel containing a large quantity of titanium is likely to close the tundish nozzle, while the corrosion of the tundish or submerged nozzle, or the like is likely to occur if steel contains only a small quantity of titanium. On the other hand, steel E of this invention is suitable for a long period of continuous casting without causing any trouble.

The steel of this invention is very economical, since boron is the only metal used therein for alloying purposes. The cost of the boron employed for the steel of this invention is less than half the cost of boron, aluminum and titanium employed in conventional boron steel.

The steel of this invention is a carbon steel, or an inexpensive low alloy steel of the Si-Mn-Cr series containing 6 to 30 ppm of acid-soluble boron. An acid-soluble boron content which is less than 6 ppm may fail to produce steel having satisfactory hardenability, while more than 30 ppm of acid-soluble boron is not only unnecessary, but also even lowers the ductility of steel.

The steel of this invention preferably does not contain any aluminum. The quantity of aluminum indicated as being present (not more than 0.008%) is the quantity of aluminum which is unavoidably present in the steel. If the steel contains a larger quantity of aluminum, it is likely to crack during hot rolling, and close the nozzle during continuous casting. The same is true of titanium. The quantity of titanium indicated as being present (not more than 0.010%) is the quantity which is unavoidably present in the steel. If the steel contains a larger quantity of titanium, it is likely to crack during hot rolling, and corrode the refractories during continuous casting. The ordinary boron steel contains 0.03% or more of titanium, and if it is quenched and tempered to produce high tensile strength steel, it has a low initial ductility which may result in a delayed fracture.

The conventional boron steel contains a minimum of boron and large quantities of aluminum and titanium to obtain a maximum degree of hardenability and grain refining. According to this invention, however, no aluminum or titanium is positively added, but a large quantity of boron is added to maintain an optimum quantity of acid-soluble boron to ensure the satisfactory hardenability of steel.

The steel of this invention has the following advantages:

(1) It produces high tensile strength steel having an improved initial delayed-fracture resistance;

(2) A continuous cast billet does not have any cracks formed in its surface even if it is directly hot rolled;

(3) It does not cause any nozzle closing or corrosion during continuous casting; and (4) The cost of alloying is less than half that of conventional steel.

The steel of this invention contains not more than 1.0% Cr. If it contains more chromium, it fails to provide high tensile strength steel having desired properties. A billet is less likely to crack if it is charged into a heating furnace at a temperature close to 900° C., as shown in Table 2. It should preferably be charged into the furnace at a temperature of at least 700° C., since it is highly likely to crack if charged at a lower temperature.

While the invention has been described in detail and with reference to specific embodiment thereof, it will be apparent to one skilled in the art that various changes and modifications can be made therein without departing from the spirit and scope thereof.

What is claimed is:

1. Boron-treated low alloy carbon steel, consisting essentially of:
   - 0.15 to 0.85% C;
   - 0.15 to 2.0% Si;
   - 0.3 to 1.5% Mn;
   - 1.0% or less of Cr;
   - 0.020% or less of P and S each;
   - at least 40 ppm of the total B to obtain 6 to 30 ppm of acid-soluble Boron;
   - 0.008% or less of Al;
   - 0.010% or less of Ti; the balance being Fe and unavoidable other impurities.

2. A process for producing a Boron-treated low alloy carbon steel, comprising the steps of:
   - continuously casting a billet of low alloy carbon steel, the steel consisting essentially of:
   - 0.15 to 0.85% C;
   - 0.15 to 2.0% Si;
   - 0.3 to 1.5% Mn;
   - 1.0% Cr or less;
   - 0.020% or less of P and S each;
   - at least 40 ppm of the total B to obtain 6 to 30 ppm of acid-soluble Boron;
   - 0.008% or less of Al;
   - 0.010% or less of Ti; the balance being Fe and unavoidable other inpurities;
   - charging said billet into a heating furnace while the surface temperature of said billet is 700° C. or more; and
   - heating and hot rolling said billet.

3. A process for producing a boron-treated steel as claimed in claim 2, wherein the billet is charged into the heating furnace while having a surface temperature of about 900° C.

* * * * *